United States Patent [19]

Martin

[11] Patent Number: 4,765,154

[45] Date of Patent: Aug. 23, 1988

[54] COIN HOLDER

[76] Inventor: Roger Martin, 45 E. Walnut St., Central Islip, N.Y. 11722

[21] Appl. No.: 13,257

[22] Filed: Feb. 11, 1987

[51] Int. Cl.[4] ..... A44C 21/00; A44C 25/00

[52] U.S. Cl. ..... 63/23; 63/2.1

[58] Field of Search ..... 63/2, 18, 23, 26, 1.1

[56] References Cited

U.S. PATENT DOCUMENTS

| | | | |
|---|---|---|---|
| 509,888 | 12/1983 | Gaynor | 63/23 |
| 509,889 | 12/1893 | Gaynor | 63/23 |
| 2,208,642 | 7/1940 | Neuwirth | 63/29 R |
| 3,670,524 | 6/1972 | Korwin | 63/18 |
| 3,678,705 | 7/1972 | Korwin | 63/18 |
| 3,964,187 | 6/1976 | Stumpf | 63/18 |
| 4,091,639 | 5/1978 | Benda | 63/18 |
| 4,142,382 | 3/1979 | Fix | 63/2 |

FOREIGN PATENT DOCUMENTS

| | | | |
|---|---|---|---|
| 2321858 | 3/1977 | France | 63/23 |
| 7971 | of 1915 | United Kingdom | 63/23 |

*Primary Examiner*—Richard J. Johnson

*Attorney, Agent, or Firm*—Michael I. Kroll

[57] ABSTRACT

A coin holder ring is provided and consists of a flexible body engaging member having spaced end portion for receiving a cap. Securing the cap on the end portions urges the body engaging member about a coin so that a channel-shaped felt protector within an internal annular slot in the body engaging member will safely hold the peripheral edge of a coin thereto.

5 Claims, 1 Drawing Sheet

COIN HOLDER

BACKGROUND OF THE INVENTION

1. Field of the Invention

The instant invention relates generally to circular mounting frames and more specifically it relates to a coin holder ring.

2. Description of the Prior Art

Numerous circular mounting frames have been provided in prior art that are adapted to surround a body at its peripheral edge. For example, U.S. Pat. Nos. 2,208,642; 2,358,262 and 4,142,382 all are illustrative of such prior art. While these units may be suitable for the particular purpose to which they address, they would not be as suitable for the purposes of the present invention as heretofore described.

SUMMARY OF THE INVENTION

A principle object of the present invention is to provide a coin holder ring that will overcome the short comings of the prior art devices.

Another object is to provide a coin holder ring that includes a cap that threads onto end portions of a flexible body engaging member which will cause the body engaging member to clamp around the coin.

An additional object is to provide a coin holder ring that is ornamental and attractive in appearance.

A further object is to provide a coin holder ring that is simple and easy to use.

A still further object is to provide a coin holder ring that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
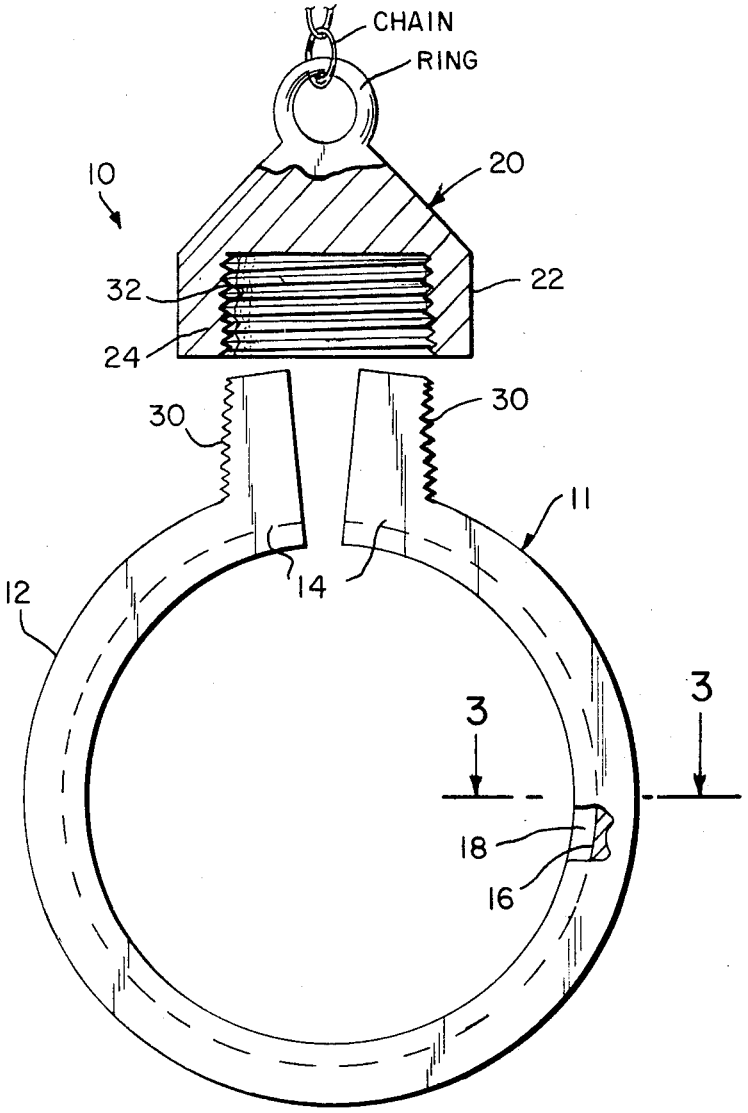
FIG. 1 is an exploded front elevational view partly in section of the invention.
Figure 2:
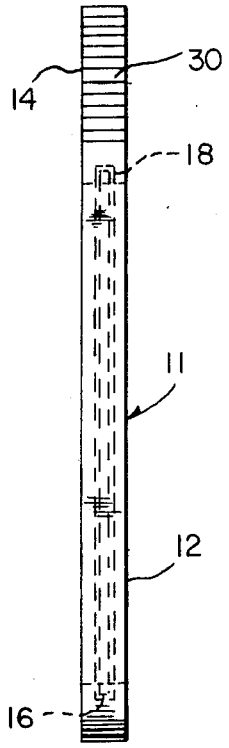
FIG. 2 is a side view thereof.
Figure 3:
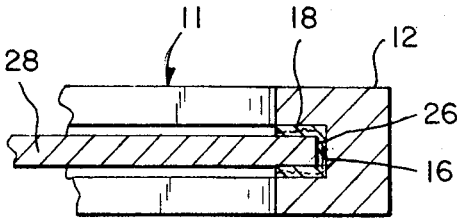
FIG. 3 is an enlarged cross sectional view taken along line 3—3 in FIG. 1 showing the felt protector in greater detail.

Turning now descriptively to the drawings, in which similar reference characters denote similar elements throughout the several views, FIGS. 1 through 3 illustrates a coin holder ring 10 which contains a body engaging member 11 that has an open ring-shaped portion 12, a pair of spaced flat tabs 14 at ends thereof and an internal annular slot 16 therein. A channel-shaped felt protector 18 is affixed within the internal annular slot 16 of the ring-shaped portion 12.

A cap 20 is shown that has a hollow body 22. The flat tabs 14 and internal wall 24 of the hollow body 22 is sloped relative to one another to adjust size of the ring-shaped portion 12 when the hollow body 22 is displaced relative to the tabs 14.

The cap 20 can be secured on the flat tabs 14 for urging the tabs together to decrease inside dimension of the ring-shaped portion 12. The channel-shaped felt protector 18 within the internal annular slot 16 of the ring-shaped portion 12 will safely hold the peripheral edge 26 of a coin 28 thereto.

The flat tabs 14 have external threads 30 while the hollow body 22 has internal threads 32. The flat tabs 14 are also angled relative to one another while the hollow body 22 has a generally constant internal diameter.

The cap 20 also includes an eyelet 34 formed opposite the hollow body 22 so that the cap 20 can engage with a chain 36 or the like.

The cap 20 and the ring-shaped portion 12 can be fabricated out of durable materials such as various types of metals generally used for jewelry or plastic, wood, etc.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A coin holder ring which comprises:

(a) a body engaging member having an open ring-shaped portion lying in a plane, a pair of spaced flat tabs at ends thereof lying in said same plane, and an internal annular slot therein;

(b) a cap having a hollow body with an internal wall; and (c) means for adjustably securing said cap on said flat tabs while urging said flat tabs together, said flat tabs being sloped relative to said internal wall of said hollow body and said cap being displaced onto said flat tabs a distance until said ring portion automatically captures and secures the peripheral edge of the coin so that different sized coins may be automatically captured by said ring portion by merely tightening or loosening said cap.

2. A coin holder ring as recited in claim 1, wherein said securing means includes:

(a) said flat tabs having external threads; and (b) said hollow body having internal threads.

3. A coin holder ring as recited in claim 2, wherein said securing means includes:

(a) said flat tabs angled relative to one another; and (b) said hollow body having a generally constant internal diameter.

4. A coin holder ring as recited in claim 3, wherein said cap includes an eyelet formed opposite said hollow body so that said cap can engage with a chain or the like.

5. A coin holder ring as recited in claim 1; further comprising a channel-shaped felt protector affixed within said internal annular slot of said ring-shaped portion.

* * * * *